US005582257A

United States Patent [19]

Kimberlin et al.

[11] Patent Number: 5,582,257

[45] Date of Patent: Dec. 10, 1996

[54] SYSTEM FOR LUBRICATING AND RECIPROCATING A PISTON IN A FLUID-ACTIVATED, PERCUSSIVE PAVING BREAKER

[75] Inventors: Robert R. Kimberlin; Steven W. Bodell, both of Troutville; Ted C. Chang; Robert M. Diesel, both of Roanoke; Scott Barker, Daleville, all of Va.

[73] Assignee: Ingersoll-Rand Company, Woodcliff Lake, N.J.

[21] Appl. No.: 545,445

[22] Filed: Oct. 17, 1995

Related U.S. Application Data

[62] Division of Ser. No. 282,356, Jul. 29, 1994, Pat. No. 5,524,714.

[51] Int. Cl.[6] ..... B25D 17/04

[52] U.S. Cl. ..... 173/62; 173/73; 173/138; 173/170

[58] Field of Search ..... 173/61, 62, 63, 173/73, 74, 78, 17, 199, 168, 170, 138, 169

[56] References Cited

U.S. PATENT DOCUMENTS

| | | | |
|---|---|---|---|
| 1,233,477 | 7/1917 | Hultquist | 173/62 |
| 1,658,330 | 2/1928 | Gilman | 173/62 |
| 1,947,430 | 2/1934 | Demooy . | |
| 2,001,718 | 5/1935 | Gartin | 173/73 |
| 2,251,224 | 7/1941 | Curtis | 173/73 |
| 2,562,468 | 7/1951 | Lear | 173/63 |
| 2,572,841 | 10/1951 | Osgood et al. | 173/73 |
| 4,183,414 | 1/1980 | Tamai et al. . | |
| 5,259,463 | 11/1993 | Bodell et al. | 173/73 |
| 5,307,881 | 5/1994 | Kimberlin . | |

*Primary Examiner*—Scott A. Smith
*Attorney, Agent, or Firm*—John J. Selko

[57] ABSTRACT

A system for lubricating and reciprocating a piston in a fluid-activated, percussive paving breaker includes a unitary valve assembly positioned within a bore of a rear portion of a tool housing, the valve assembly having an oil reservoir for lubricating the piston. The valve assembly is retained in place by a combination of a throttle lever and a backhead plate bolted to the rear tool housing.

3 Claims, 4 Drawing Sheets

SYSTEM FOR LUBRICATING AND RECIPROCATING A PISTON IN A FLUID-ACTIVATED, PERCUSSIVE PAVING BREAKER

This is a Divisional of application Ser. No. 08/282,356 filed Jul. 29, 1994 now U.S. Pat. No. 5,524,714.

BACKGROUND OF THE INVENTION

This invention relates generally to fluid-activated, percussive breakers, and more particularly a system for simultaneously lubricating and reciprocating a piston in a pneumatic paving breaker. Past and current pneumatic paving breakers usually have a separate lubricator outside of the tool, or a lubricator reservoir built into the breaker handle, with a separate and complex oil metering device. The repair and replacement of the oil metering and filtering device can be time consuming and complicated. The valve assembly that reciprocates the piston in prior art devices consisted of separate, machined steel parts that were expensive to manufacture, and that added excessive weight to the tool.

The foregoing illustrates limitations known to exist in present paving breakers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a system for simultaneously lubricating and reciprocating a piston within a bore of a housing of a fluid-activated paving breaker comprising:

said housing having a rear housing portion, with said bore extending axially therethrough; an inlet port for transmitting high pressure fluid into said rear housing bore; valve assembly means removably mounted in said rear housing bore, for communicating high pressure fluid with a drive chamber and low pressure fluid with a return chamber in said housing bore, whereby said the piston is reciprocated, said valve assembly means positioned axially within said rear housing bore with respect to said inlet port so that high pressure fluid contacts a top surface of said valve assembly means when said inlet port is opened; means for retaining said valve assembly means within said rear housing bore; means for injecting a lubrication fluid into said rear housing bore; and means for opening and closing said inlet port.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
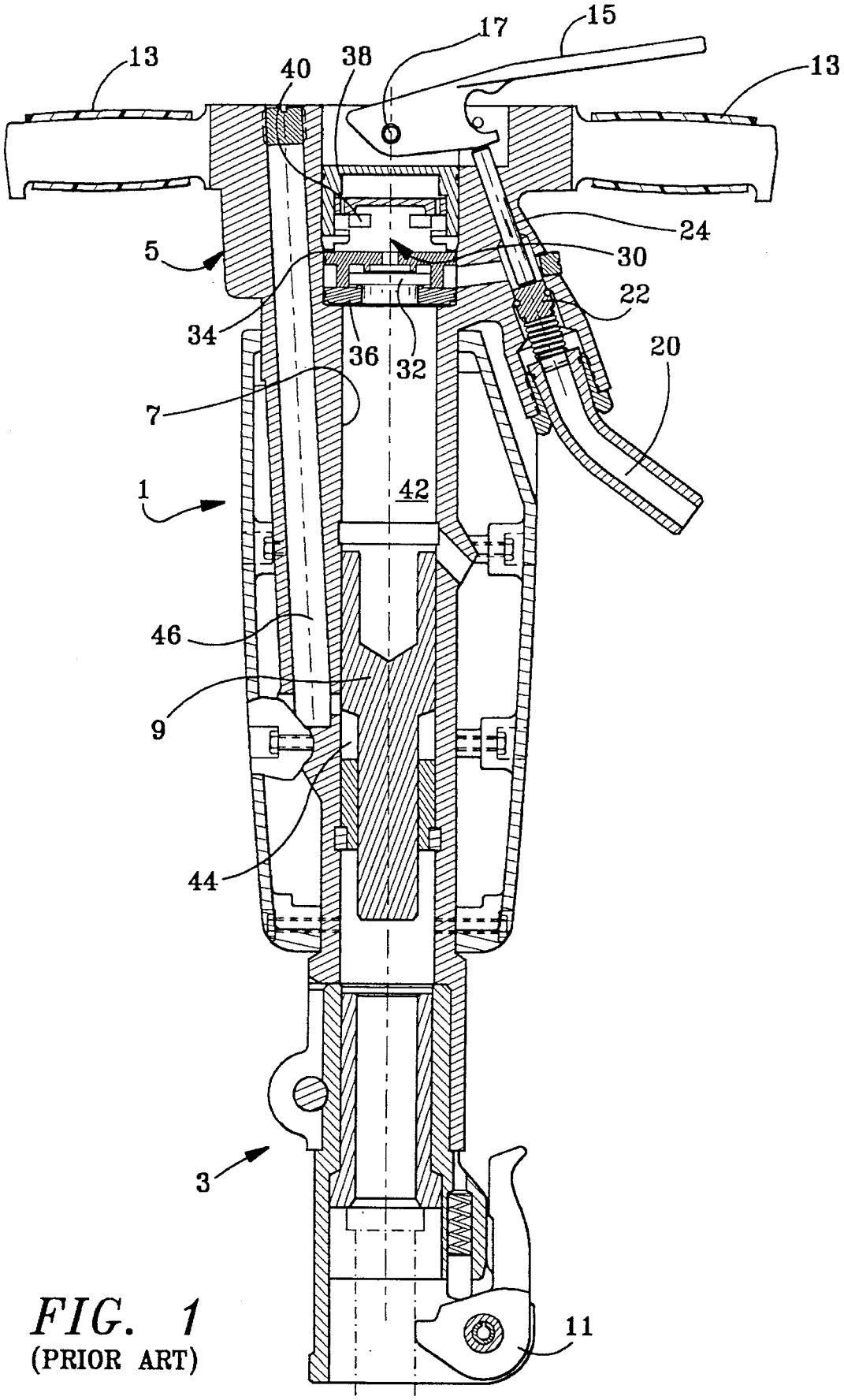
FIG. 1 (PRIOR ART)
FIG. 1 is an elevational cross-section of a prior art paving breaker, with parts removed.

Now referring to FIG. 1 a prior art breaker is shown generally as 1. The breaker includes a housing forming front head 3, a rear portion 5 of the main housing (herein the "rear housing") and a bore 7 extending longitudinally (axially) from rear housing 5 to front head 3. Within bore 7 is reciprocal piston 9. Front head 3 is equipped with a tool retaining latch 11. Rear housing 5 has handles 13 mounted thereon, along with a throttle lever 15 that pivots about a pivot pin 17 that is connected to rear housing 5. Inlet port 20 receives high pressure air to percussively actuate the device. Within inlet port 20 is an inlet valve 22 that is spring loaded to a normally closed position. Valve stem 24 contacts lever 15 and opens inlet valve 22, as lever 15 is depressed. When lever 22 is released, the bias of inlet valve 22 closes the Valve and raises lever 15.

Positioned within bore 7 is valve assembly 30. Valve assembly 30 consists of a plurality of separate steel members, namely valve 32, valve chest 34, valve bottom plate 36 and valve plug 38 threaded into bore 7 against spring 40 to retain valve assembly 30 in place. Drive chamber 42 receives high pressure air and actuates piston 9 downward. Return chamber 44 receives low pressure air via gun drill passage 46 and actuates piston 9 upwardly. As used herein, "high pressure" refers to the line pressure into the device, and "low pressure" refers to pressure less than the line pressure. Valve assembly 30 opens and closes high and low pressure chambers, 42 and 44, respectively, based on the position of piston 9, as is well known.

Figure 2:
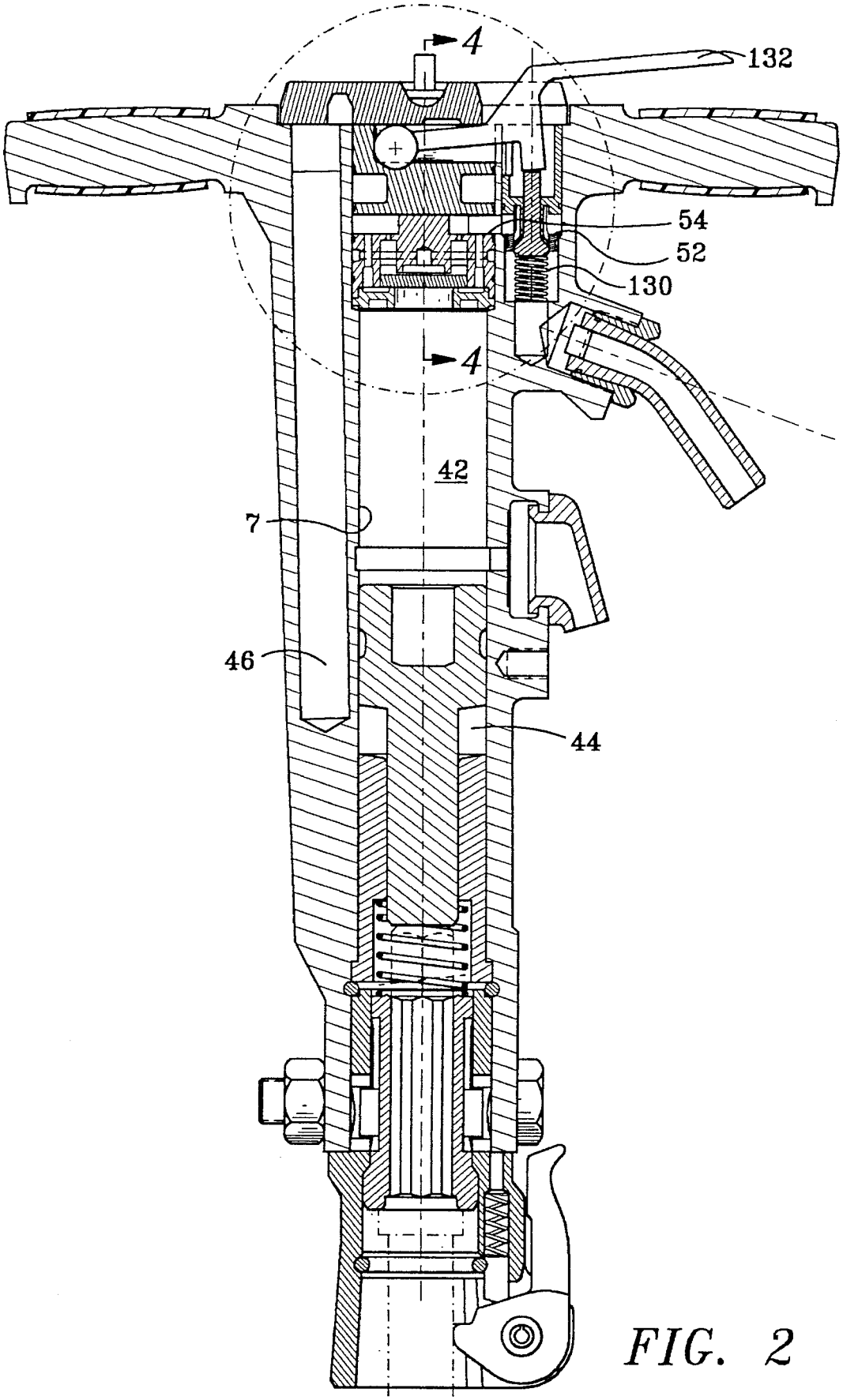
FIG. 2 is a view similar to FIG. 1 of a paving breaker incorporating this invention therein.
Figures 3, 4:
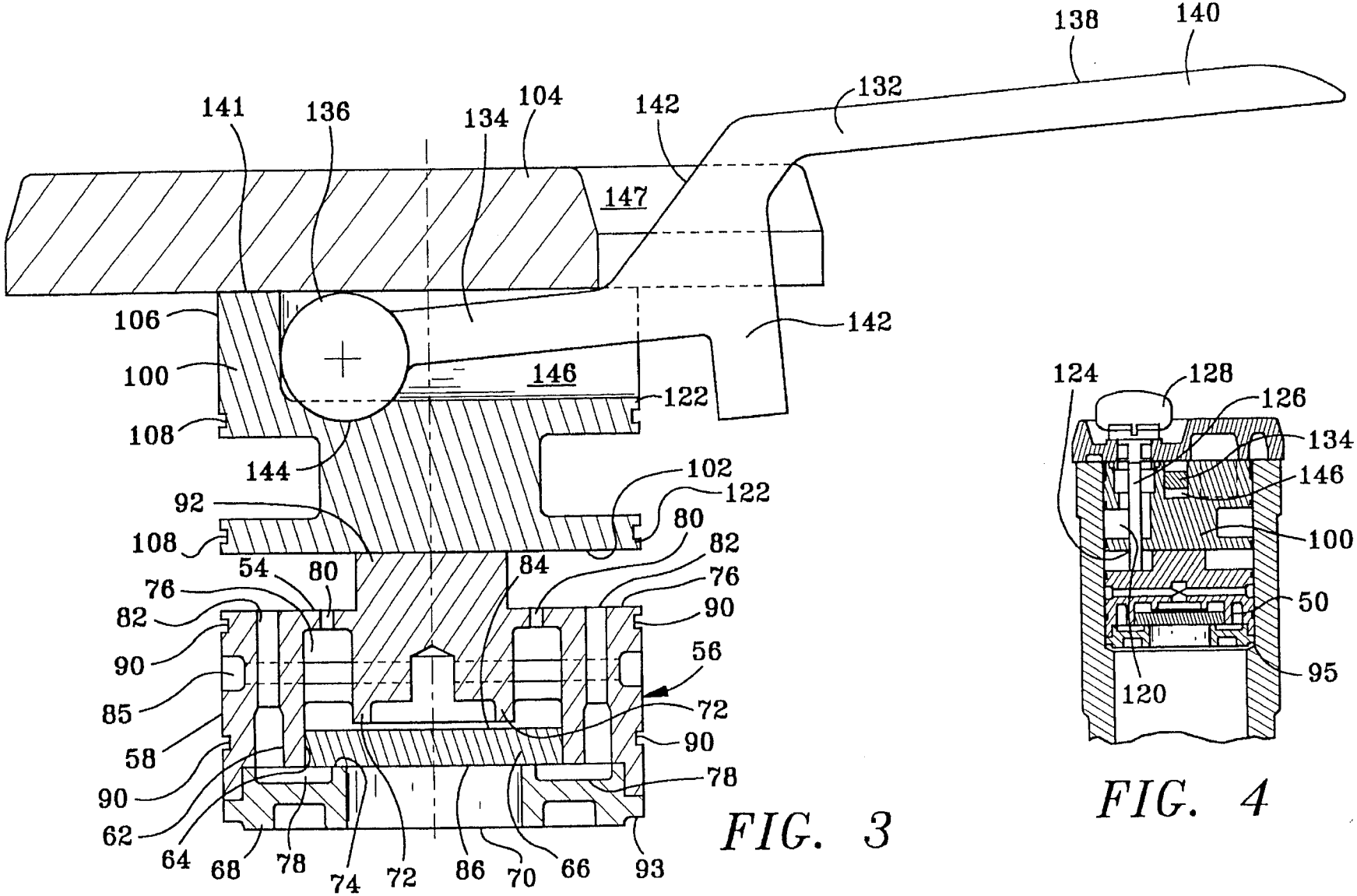
FIG. 3 is an expanded view, with parts removed, of the circled portion of FIG. 2.
FIG. 4 is a view along A—A of FIG. 2.
Figure 5:
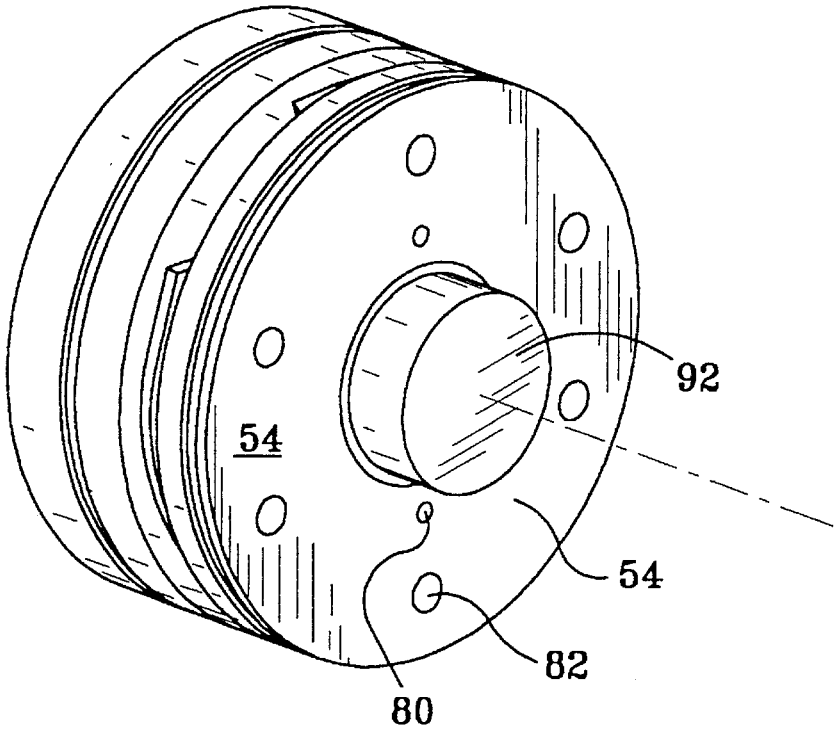
FIG. 5 is a top isometric view of a valve chest of this invention.

Now referring to FIGS. 2–4, the system of this invention will be described.

Figure 6:
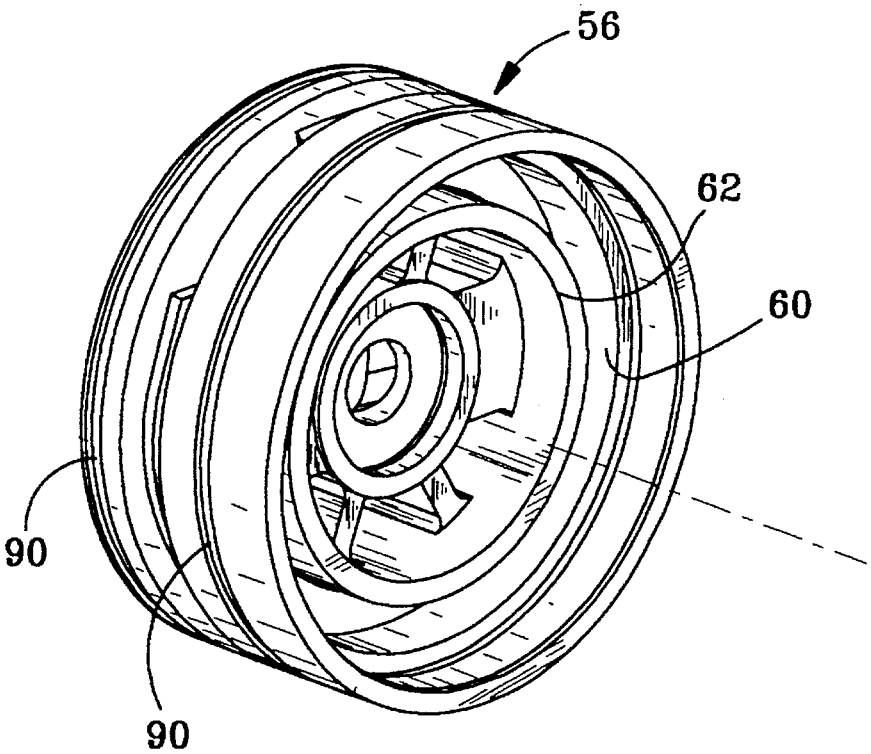
FIG. 6 is bottom isometric view of the valve chest of FIG. 5 showing the internal valve chamber structure.

Valve assembly means 50 is removably mounted in rear housing bore 7. Valve assembly 50 is positioned axially within bore 7 with respect to inlet port opening 52 so that high pressure air contacts a top surface 54 of valve assembly 50 when inlet port 52 is opened. As shown in FIGS. 3 and 4, valve assembly 50 comprises a valve chest 56 substantially the same cross-sectional size and shape of bore 7. Valve chest 56 includes top surface 54 and an outer sidewall 58 extending axially from top surface 54 to form an internal valve chamber 60 (FIG. 6). An inner sidewall 62 within valve chamber 60 extends axially from top surface 54, and parallel to outer sidewall 58,to form a valve bore 64 in valve chamber 60. Annular bottom plate 68 is connected to outer sidewall 58 in fluid sealing contact. Bottom plate 68 has aperture 70 therethrough concentric with bores 7 and 64. Valve 66 reciprocates in bore 64, and alternately seats against first raised annular sealing seat 72 formed by inner sidewall 62 and, thereafter, against second raised annular sealing seat 74 formed by bottom plate 68. Valve 66, inner sidewall 62 and bottom plate 68 divide internal chamber 60 into a high pressure portion 76 and a low pressure portion 78.

A plurality of first apertures 80 through top surface 54 open into low pressure portion 78. A plurality of second apertures 82 open into high pressure portion 76. Apertures 80 have a smaller cross sectional size than apertures 82. Thus, valve 66 has a first pressure surface 84 exposed to whatever pressure is present in low pressure portion 78, plus return chamber 44 via transverse passage 85 that connects to gun drill passage 46. Likewise, valve 66 has a second pressure surface 86 exposed to whatever pressure is present in high pressure portion 76, plus drive chamber 42 via aperture 70. The position of valve 66 is controlled by the balancing of forces acting on first and second pressure surfaces 84, 86, by the position of piston 9, whereby valve 66 is caused to reciprocate in valve bore 64 against sealing seats 72, 74.

Outer sidewall 58 includes at least one groove 90 (we prefer 2 grooves) extending circumferentially around outer sidewall 58 for retaining therein an elastomeric 0-ring (not shown) to provide fluid tight sealing against the inner surface of bore 7. Bottom plate 68 also has a shoulder 93 for retaining an 0-ring (not shown) against a shoulder 95 formed in bore 7 (FIG. 4), when valve assembly 50 is inserted into bore 7. Top surface 54 includes an axially extending stop member 92 for providing a stop for the means used for retaining valve assembly 50 in bore 7, as now described.

A valve housing plug 100 substantially the same cross-sectional size and shape as bore 7 is removably inserted in bore 7. Bottom surface 102 of plug 100 and top surface 54 of valve assembly 50 form a volumetric chamber suitable for receiving high pressure fluid inside the bore 7. This high pressure fluid, acting against top surface 54, cushions valve assembly 50 against mechanical shock during operation and results in significantly improved life of the entire valve assembly 50, as compared to prior art valve assemblies.

Outer sidewall 106 of plug 100 includes at least one groove 108 (we prefer 2 grooves) extending circumferentially around outer sidewall 106 for retaining therein an elastomeric 0-ring (not shown) to provide fluid-tight sealing against the inner surface of bore 7. A backhead plate 104 is removably bolted to rear housing 5, plate 104 contacting plug 100 to retain plug 100 in bore 7.

The means for injecting lubrication into the device will now be described. As seen in FIGS. 3 and 4, an oil chamber 120 extends into plug 100 through backhead plate 104. Chamber 120 is formed by a pair of parallel land portions 122 spaced apart from each other, and extending circumferentially around outer surface of sidewall 106. Lands 122 carry the aforesaid grooves 108, and seal against the inner surface of bore 7 to form an oil reservoir. Oil enters the space between plug 100 and valve assembly 50 via aperture 124 (FIG. 4). Within aperture 124 and chamber 120 is an elongated oil filter 126 made from a conventional filtering material. Screw cap 128, extending through an aperture in backhead plate 104, closes chamber 120 from the outside, and captures filter 126 in place. The elongated body of filter 126 provides enhanced filtering and longer life than prior art filters. Access to filter 126 from the top opening of chamber 120 facilitates inspection and field replacement of filter 126.

The throttle means will now be described. Inside inlet port opening 52 is inlet valve 130. Valve 130 is elastically biased in a normally closed position. Throttle lever 132 opens valve 130. Throttle lever 132 comprises an elongated body member having a first portion 134 (FIG. 3) terminating in a curved pivot surface 136. A second portion 138 terminates in an operator's hand contact surface 140. Pivot surface 136 is pivotally retained in a pocket 144 formed in top surface 141 of plug 100. First portion 134 is slidably retained in a slot 146 formed in top surface 141 (FIGS. 3 and 4). Backhead plate 104 traps throttle lever 132 in slot 146 and pocket 144.

Intermediate portion 142 contacts valve 130 to open valve 130, when lever 132 is pivoted downward by operator pressure. When pressure is released from throttle lever 132, valve 130 closes and raises throttle lever 132. As shown in FIG. 3, First portion 134 of throttle lever 132 is trapped between backhead plate 104 and top surface 141 within slot 146 in plug 100. Second portion 138 of lever 132 is essentially parallel to, but offset from, first portion 134, as viewed in elevation. Intermediate portion 142 extends diagonally between portions 134 and 138. Intermediate portion extends through a slot 147 in backhead plate 104 to position second portion above backhead plate 104.

It should be understood that the valve assembly 50 is of a unitary construction, that is, it is assembled as a complete unit, and replaced as a complete unit. This is accomplished by assembling valve 66 in bore 64 and permanently fixing bottom plate 69 to valve chest 56. We prefer to make the valve assembly 50 and the plug 100 from an acetal resin supplied by E.I. du Pont de Nemours & Co. under the registered trademark DELRIN. We prefer the filter to be a polyethylene material having a porosity of 2.0 microns. We prefer the throttle lever to be steel, for its strength.

Having described the invention, what is claimed is:

1. A system for simultaneously lubricating and reciprocating a piston within a bore of a housing of a fluid-activated paving breaker comprising:

(a) said housing having a rear housing portion, with said bore extending axially therethrough forming a rear housing bore;

(b) handles mounted on said rear housing portion adjacent said rear housing bore;

(c) an inlet port for transmitting high pressure fluid into said rear housing bore;

(d) valve assembly means removably mounted in said rear housing bore, for communicating high pressure fluid with a drive chamber and low pressure fluid with a return chamber in said housing bore, said valve assembly means positioned axially within said rear housing bore with respect to said inlet port so that high pressure fluid contacts a top surface of said valve assembly means when said inlet port is opened;

(e) means for retaining said valve assembly means within said rear housing bore;

(f) means for injecting a lubrication fluid into said rear housing bore through said rear housing portion; and (g) means for opening and closing said inlet port.

2. The system of claim 1 wherein said means for injecting a lubrication fluid into said rear housing bore against said top surface of said valve assembly means comprises:

(a) a valve housing plug, substantially the same cross-sectional shape and size as said rear housing bore removably inserted into said rear housing bore;

(b) an oil chamber extending into said housing plug, said oil chamber having an opening at a top surface of said housing plug;

(c) an aperture connecting said oil chamber to said high pressure chamber between said valve assembly means and said housing plug; and (d) porous filter means in said aperture for filtering said oil from said oil chamber as said oil flows into said high pressure chamber.

3. The system of claim 2 wherein said means for opening and closing said inlet port comprises:

(a) valve means in said inlet port for alternately opening and closing said inlet port, said valve means elastically biased in a normally closed position;

(b) throttle lever means on said rear housing for opening said valve means;

(c) said throttle lever means comprising:

i and elongated body member having a first portion terminating in a pivot end having a curved pivot surface; a second portion terminating in an operator's hand contact surface, and an intermediate portion between said first and second portions, for contacting said valve means;

ii said pivot surface pivotally retained in a pocket formed in said top surface of said housing plug;

iii said first portion extending between a backhead plate removably connected to said rear housing portion and said top surface of said housing plug and slidably retained in a slot formed in said top surface of said housing plug; and iv said second portion extending above said backhead plate;

(d) said valve means being elastically normally biased toward said throttle lever intermediate portion; and (e) whereby said throttle lever pivots about said pivot end in a first direction, in response to operator pressure on said hand contact surface and in a second direction in response to said biased valve means.

* * * * *